US005775495A

United States Patent [19]

Lang

[11] Patent Number: 5,775,495

[45] Date of Patent: Jul. 7, 1998

[54] VERSATILE ARTICLE CARRIER

[76] Inventor: Mark Everett Lang, 403 Dove La., Hampstead, Md. 21074

[21] Appl. No.: 779,325

[22] Filed: Jan. 6, 1997

[51] Int. Cl.[6] ..... B65D 85/20

[52] U.S. Cl. ..... 206/315.1; 190/102

[58] Field of Search ..... 206/315.1; 190/102, 190/107, 115, 116, 123; 383/4; 150/107

[56] References Cited

U.S. PATENT DOCUMENTS

| | | | |
|---|---|---|---|
| 1,727,954 | 9/1929 | Beehler | 190/102 |
| 4,561,480 | 12/1985 | Underwood et al. | 383/4 |
| 4,606,070 | 8/1986 | Schachter | 383/4 |
| 4,911,271 | 3/1990 | Stanley | 190/102 |
| 5,048,582 | 9/1991 | Whitfield | 190/102 |
| 5,251,743 | 10/1993 | Palido et al. | 384/4 |
| 5,353,900 | 10/1994 | Stilley | 190/115 |
| 5,451,107 | 9/1995 | Ricker | 383/4 |

*Primary Examiner*—David T. Fidei
*Attorney, Agent, or Firm*—Rosenberg, Klein & Bilker

[57] ABSTRACT

There is provided a versatile article carrier (10) generally comprising a pair of longitudinally extended frame members (100), a carrier body member (200) coupled to the frame members (100); a securing device (300) coupled to at least one of either the frame or carrier body members (100, 200); and, a handling strap (400) coupled to the frame members (100). The carrier body member (200) includes a substantially flexible panel portion (215) and a pair of end portions (210) coupled to the frame members (100) between which the panel portion (215) extends to form an article carrying structure. The carrier body member (200) has formed thereon at least one article-receiving compartment. Preferably, the carrier body member (200) is formed of flexible cloth, and the securing device (300) includes at least a pair of looped strap members (310) which engage one of the frame members (100) to adjustably and firmly secure an item, such as a folded beach umbrella, against that frame member (100).

13 Claims, 4 Drawing Sheets

VERSATILE ARTICLE CARRIER

BACKGROUND OF THE INVENTION

1. Field of the Invention

The subject versatile article carrier is generally directed to an apparatus for carrying a plurality of discrete articles such as utensils, tools, and other portable personal belongings. More specifically, the versatile article carrier is an apparatus for carrying a plurality of such articles having a wide variety of structural configurations. As such, the subject versatile article carrier enables a user to not only carry simultaneously a plurality of discrete articles, it also enables him or her to carry along with other variously configured articles those articles having a shape or dimension of sufficient irregularity to render the similar carrying thereof by any other means extremely difficult and awkward.

In countless situations, the need exists to transport by hand a plurality of articles from one point to another wherein the articles are much too bulky to be collectively carried by a single person, although the collective weight of the articles may not exceed that which a person of typical strength could comfortably carry. Even where an equipment bag, a trunk, or other such carrying aids are available to the user, the carrying aid is of limited effectiveness in enabling the user to simultaneously carry all of the articles. In many situations, the shape-irregularity of the articles, coupled with their bulkiness, often prevent their secure containment within the structural confines of such carrying aids.

With beach paraphernalia, for instance, no suitable means currently exists for conveniently toting in collective manner all items typically utilized during a beach outing. Such beach items often include sand toys, tanning lotion containers, books, towels, blankets, coolers, umbrellas/parasols, and foldable beach chairs. While devices for conveniently toting one or some of these items may currently be available, a device versatile enough to enable the user to carry all of these items without requiring of that user great dexterity and physical exertion is not available. The need for such a device is, therefore, quite apparent, at least where the aid of numerous capable persons cannot be obtained.

The need is even more apparent when one considers that except in a few notable cases, convenient automobile access to locations of a beach desirable for occupation during a beach outing is invariably non-existent. Even where housing on beachfront property has been obtained, the distance from the property to the stretch of beach sufficiently close to the water to be desirable for occupation very often remains relatively far. To make more than a single trip transporting the necessary items to and from the desired location, therefore, typically becomes extremely inconvenient, especially during sun-drenched summer afternoons when the hot sand makes even more difficult the already arduous task of walking through sand with an armload of bulky items.

2. Prior Art

Carriers for toting various beach articles are known. The best prior art known to Applicant includes U.S. Pat. Nos. 5,482,374; 5,110,219; 4,606,070; 4,489,815; 3,590,864; 5,443,880; 4,911,271; 5,346,308; 5,480,229; 5,454,643; 5,147,102; 4,273,380; and, D317,995. Devices such as those disclosed in these references, however, fail to offer the combination of versatile utility, and simplicity offered by the subject versatile article carrier.

U.S. Pat. No. 4,606,070 is directed to a combined wind screen and beach bag which includes a flexible screen 20 bordered by a pair of tubular hems 32 through which a pair of stakes 30 are respectively received. When not in use as a windscreen, the Patent discloses various folding configurations for the screen 20 to enable articles such as suntan lotion containers, books, and towels to be carried therein. Note that while pockets are formed on surfaces of the screen 20, the entire assembly is intended to be folded into and utilized, primarily, as a "'hobo' bag," the folded hobo bag being carried at the common ends of the pair of stakes 30 resting diagonally against one of the user's shoulders. It is clear from this that while it may be employed as a bag, the disclosed device is intended to carry articles of limited size and regularity in shape, not articles having a size and shape irregularity comparable to that of a beach umbrella or a beach chair.

Even in those embodiments where the disclosed device is not to be utilized as a hobo-type bag, such as that shown in FIG. 6, the class of articles that may be readily carried by the resulting bag remains limited to items such as suntan lotion containers, books, and towels of limited size and shape regularity. In FIG. 6, the presence of a drawstring 78 and the additional fold 62 serve to severely limit the size and shape of the articles to be carried thereby. Thus, the class of articles that may be conveniently carried clearly excludes articles such as beach umbrellas and beach chairs. No securing mechanism, moreover, is provided to enable the carrying of such oversized and shape-irregular articles outside the pockets defined by the screen 20.

Similarly, U.S. Pat. No. 3,590,864 is directed to a pliant sheet article 10 which may be convertibly utilized as a flag, canopy, or a handbag, among other things. When utilized as a handbag, as shown in FIG. 6, a pair of pole members 30 are passed through a pair of pole-receiving channels 16 peripherally formed on the pliant sheet article 10. When so utilized, a lace 44 is threaded as shown to substantially enclose the pocket formed by folding the pliant sheet article 10. Clearly, insufficient means are provided by the disclosed configuration to carry anything but articles of limited size and shape irregularity. The combination of features incorporated into the subject versatile article carrier which enables the wide range of articles to be carried by use of the carrier is simply not seen in this and other prior art references.

SUMMARY OF THE INVENTION

A primary object of the present invention is to provide a carrier which enables a user to simultaneously carry a plurality of discrete articles.

Another object of the present invention is to provide a carrier which enables a user to simultaneously carry a plurality of discrete articles having a wide range of structural configurations.

Another object of the present invention is to provide a carrier which enables a user to carry a beach umbrella in a convenient and secure manner along with a plurality of other discrete articles.

Another object of the present invention is to provide a carrier of great structural simplicity.

Yet another object of the present invention is to provide a carrier which provides great versatility of utilization yet is readily manufacturable.

These and other objects are attained by the versatile article carrier of the present invention. The subject versatile article carrier generally includes at least a pair of longitudinally extended frame members; a carrier body member coupled to those frame members for supporting the articles to be carried; a securing device coupled to at least one of either the frame or carrier body members for adjustably securing against one of the frame members an article to be carried; and, a handling strap coupled to the frame members. The carrier body member includes first and second end portions and a substantially flexible panel portion extending therebetween which has formed thereon at least one article-receiving compartment. In a preferred embodiment, the first and second end members of the carrier body member respectively form sleeve structures adapted to receive therethrough the frame members. Also in that preferred embodiment, the securing device includes at least a pair of looped strap members displaced longitudinally by a sufficient amount which engage a common one of the frame members, to adjustably and firmly secure an item such as a folded beach umbrella or parasol against that frame member.

The versatile article carrier further includes in a preferred embodiment a plurality of article-receiving compartments, at least one of which is provided with a closure mechanism which enables the contents of that compartment to be substantially enclosed therein. The closure mechanism is preferably in the form of a zipper assembly.

In an alternate embodiment, each of the frame members is transversely collapsible. Each frame member includes a hinged joint about which it is foldable. Each of the frame members in that embodiment includes detachable first and second segments longitudinally joined by the hinged joint. This hinged joint is realized in the embodiment by use of a hinged coupler having hingedly connected first and second bosses which matingly engage, respectively, the first and second segments of the given frame member.

DETAILED DESCRIPTION OF THE PREFERRED EMBODIMENTS

Figure 1:
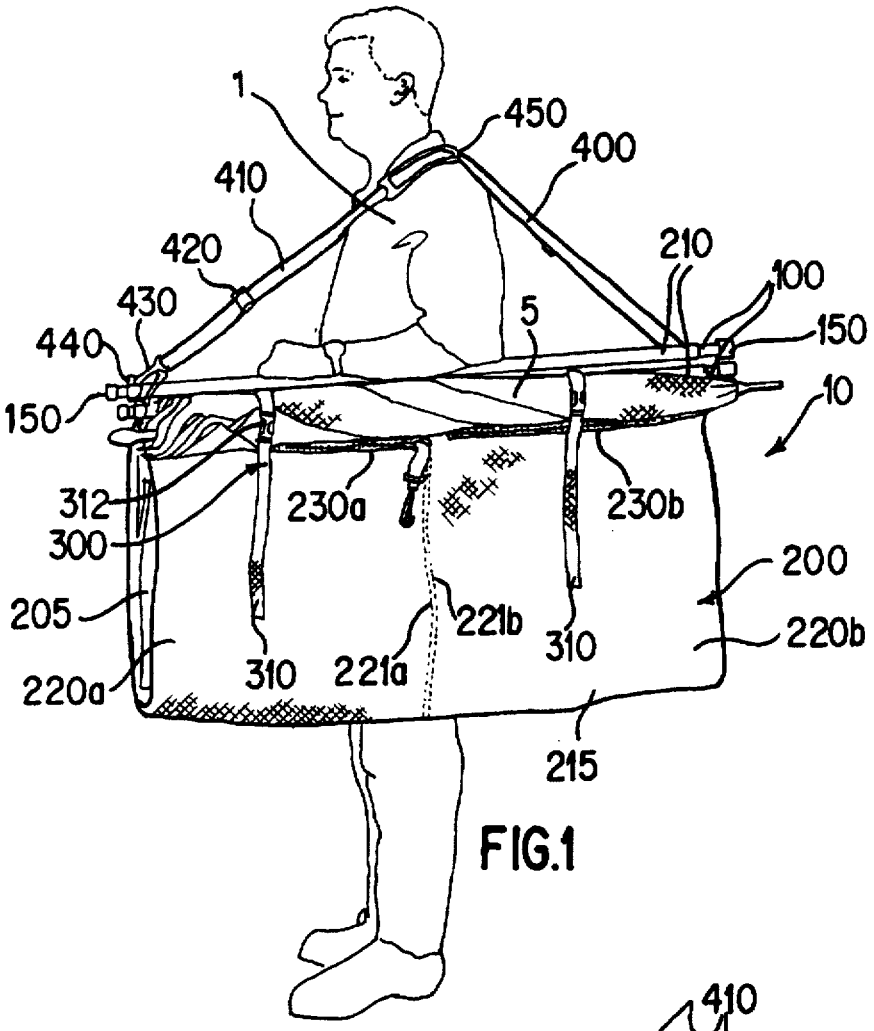
FIG. 1 is a perspective view of the subject versatile article carrier shown in its typical use.

Referring now to FIG. 1, there is shown a preferred embodiment of the subject versatile article carrier 10 in its typical use by a user 1. The subject versatile article carrier 10 generally includes a pair of frame members 100, a carrier body member 200 coupled to the frame members 100 to extend therebetween, an article securing device 300 formed by a pair of adjustable straps 310, and a handling accessory 400 preferably in the form of a pair of shoulder straps 410 coupled to the frame members 100. In broad concept, when frame members 100 are brought together in substantially laterally adjacent manner, carrier body member 200 is folded to form a sling structure defining an open-ended, articleretaining pocket 205.

To enable this function, carrier body member 200 is preferably formed of a flexible, or pliant, material such as canvas or other cloth. Carrier body member 200 includes a pair of end portions 210 for respectively engaging each of the frame members 100 and a flexible panel portion 215 extending between those end portions 210. While the end portions 210 need not be integrally formed with the panel portion 215, nor even be formed even of a flexible material, it is preferably formed of the same cloth material forming the panel portion 215 for both enhanced strength and manufacturability. More specifically, each end portion 210 is formed by suitable stitching into an elongate sleeve through which a frame member 100 may completely pass, such that the panel portion 215 may form a sling structure when frame members 100 so engaging the sleeves 210 are lifted by user 1 in their horizontal orientation. In order to ensure balance and stability, the longitudinal ends of each frame member 100 extend beyond the ends of the given sleeve 210.

Each of the sleeves 210 preferably forms a substantially contiguous engagement with a frame member 100 and thus enables the sling structure formed by the panel portion 215 suspended from the frame members 100 to be loaded by items to be toted at any point along the longitudinal extent thereof. Where necessary, however, cutouts (not shown) may alternatively be formed into one or both sleeves 210 to expose portions of a given frame member 100. Cutouts may be necessary or desirable for such purposes as direct coupling of an item to an intermediate portion of the frame member 100, enabling convenient grasping of the frame members 100, or providing clearance for the folding/collapse of the frame members 100. While these cutouts may be of any suitable shape and size; it is important that the shapes and sizes chosen do not cause the cutouts to detrimentally affect in any significant manner the load-bearing capabilities of the sling structure.

The panel portion 215 of carrier body member 200 preferably includes a plurality of compartments **220*a*, 220*b* delineated in part by stitching lines 221*a*, 221*b*. These compartments, 220*a*, 220*b*, are preferably, though not necessarily, formed on a surface of the panel portion 215 which would generally face outward when article carrier 10 is used as shown in FIG. 1. This would maximize the carrying capacity of article carrier 10 by minimizing the encroachment into pocket 205 by any protuberances of the articles contained within those compartments 220*a*, 220*b*. The outer walls of compartments 220*a*, 220*b* are dimensioned to provide sufficient slack or flexibility to facilitate any such outward protuberances of the contained articles. Note that while compartments 220*a*, 220*b* are shown formed only on the side surface of the panel portion 220 which is visible in FIG. 1; compartments 220*a*, 220*b* or the like may also be formed on that side surface of the panel portion 215 facing user 1 which is not visible in FIG. 1**.

Each compartment **220*a*, 220*b* is preferably provided with a closure mechanism such as a zipper 230*a*, 230*b* in order to substantially enclose and thereby prevent the unwanted escape of articles contained within the given compartment 220***a*, 220*b*. While a zipper 230*a*, 230*b* is shown for each compartment 220*a*, 220*b*, the closure mechanism may be formed by any one of numerous suitable closure mechanisms such as overhanging flaps, buttons, hook-and-loop fasteners, and the like.

It may be desirable, particularly when the contents of the article retaining pocket 205 are likely to cause to open sides of that sling-type pocket to unduly expand, to employ means for either closing the open sides or, at least, restraining from excessive separation the opposed walls of the carrier body member panel portion 215 which define the pocket. Any suitable means known in the prior art may be employed. Although not shown, straps stitched to opposed sections of the carrier body member panel portion 215 and equipped with mated buckle assembly components on their respective free ends may, for instance, be employed. Employment of such means would not only minimize the likelihood of loose items escaping from pocket 205, it would enhance the compactness of the load being carried by the user.

Each frame member 100 is preferably, though not necessarily, formed with a tubular contour of sufficient outer diameter to substantially fill the space provided within a sleeve 210 of carrier body member 200. Among other things, the tubular contour of each frame member 100 facilitates the insert and removal thereof into and out of a sleeve 210, while minimizing its contribution to the overall weight of versatile article carrier 10. It is important that frame member 100 be formed of a material having the strength and rigidity sufficient to, at the longitudinal length with which it is implemented in a particular embodiment, withstand buckling when carrier body member 200 is subjected to loads. Preferably, each frame member 100 is formed of a dense plastic composition such as is employed in fluid conveying pipes.

Figure 4:
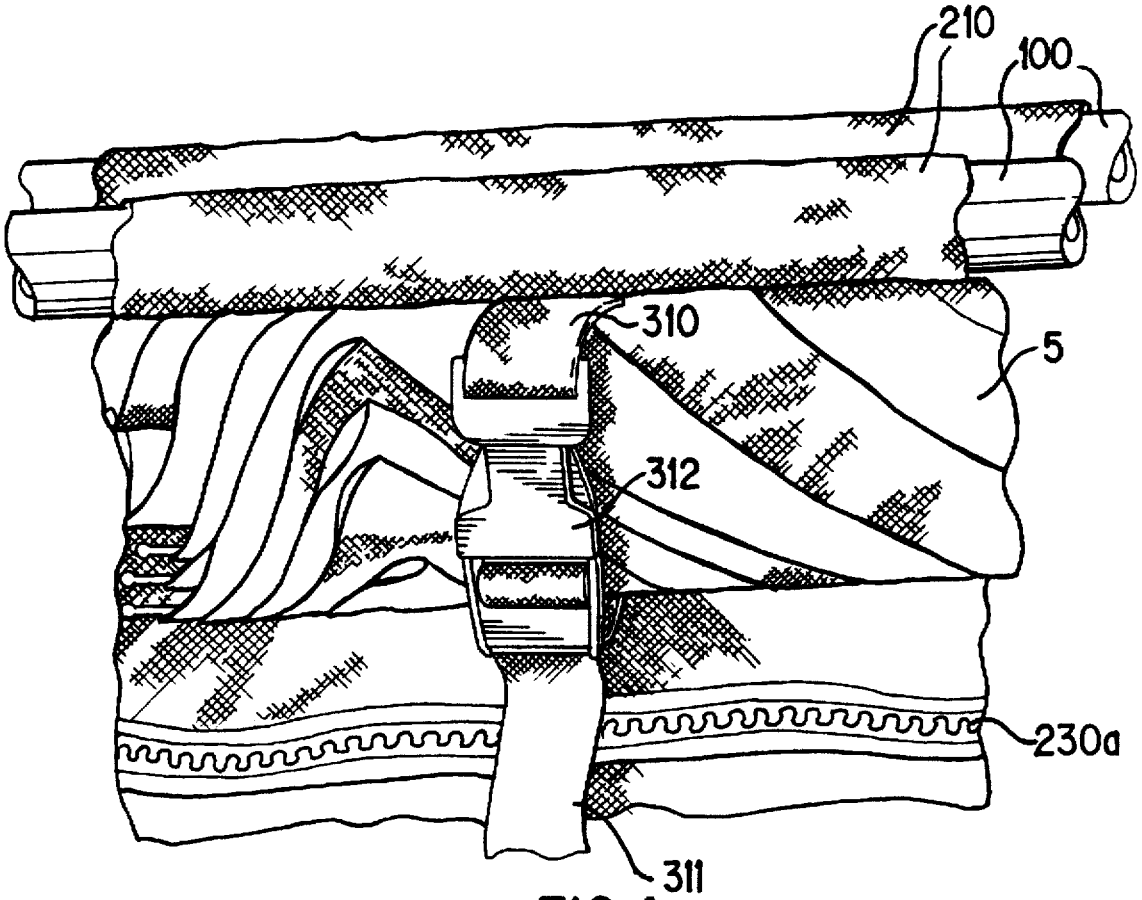
FIG. 4 is a perspective view, partially cut-away, showing another portion of the preferred embodiment of the subject versatile article carrier shown in FIG. 1.

A securing device 300 is coupled either to carrier body member 200, at a point adjacent a frame member 100, or directly to that frame member 100 in such manner that one or more items may be firmly secured thereby against the frame member 100. Preferably, as shown in FIG. 4, the securing device 300 is provided in the form of at least a pair of displaced securing straps 310, each of which is stitched, or otherwise coupled, at an intermediate portion thereof to a portion of a sleeve 210 of carrier body member 200. The ends of each securing strap 310 are respectively coupled to releasably mated components of a buckle assembly 312 which may be any one of numerous suitable buckle assemblies commercially available.

It is important that the tension with which the securing strap 310 captures against the given frame member 100 the item to be secured be adjustable. This adjustability is realized with the buckle assembly 312 employed in the preferred embodiment by a suitable technique known in the prior art, whereby a free end of the given strap 310 is guided through a component of the buckle assembly 312 to form at that buckle assembly component a strap tensioning pivot. The residual slack in the strap 310 may then be drawn out by pulling the strap 310 about the tensioning pivot to yield a length of surplus strap 311.

Securing straps 310 are separated longitudinally along the given frame member 100 by a sufficient distance such that they may, in stable manner, cooperatively secure against the frame member 100 such particularly bulky and cumbersome items as a beach umbrella 5 or a folded beach chair (not shown). Although such oversized items may be carried within the pocket 205 formed by the panel portion 215, packing efficiency as well as load stability within that pocket 205 would be significantly enhanced by the securing of the items outside the pocket 205 via the securing device 300.

If necessary, the subject versatile article carrier 10 may be carried by a user simply by grasping intermediate portions of frame members 100 and the sleeves 210 enveloping them (unless sleeves 210 are provided with cut-outs, in which case frame members 100 may be grasped through the cut-out); however, the user 1 may not be able to do so without subjecting himself or herself to strained bodily contortions. In those cases, for instance, where the bulkiness of the items contained within the pocket 205 make it impossible to draw together the frame members 100, user 1 must employ both hands to grasp the frame members 100, reaching over and across the contents of pocket 205 in doing so. This not only causes user 1 to potentially overstrain the muscles of his or her arms, back, and side; it forces him or her to assume an awkward, unbalanced posture.

A handling accessory 400 is provided to enable the user 1 to carry the article carrier 10 without such great difficulty even where the contents of the carrier 10 are quite bulky. Handling accessory 400 is preferably embodied in the form of a pair of shoulder straps 410 joined together at intermediate portions thereof by a cushioning pad 450. Each shoulder strap 410 is provided with a length adjustment buckle 420, and each releasably couples at its longitudinal ends to longitudinal end portions of the respective frame members 100.

Figure 2:
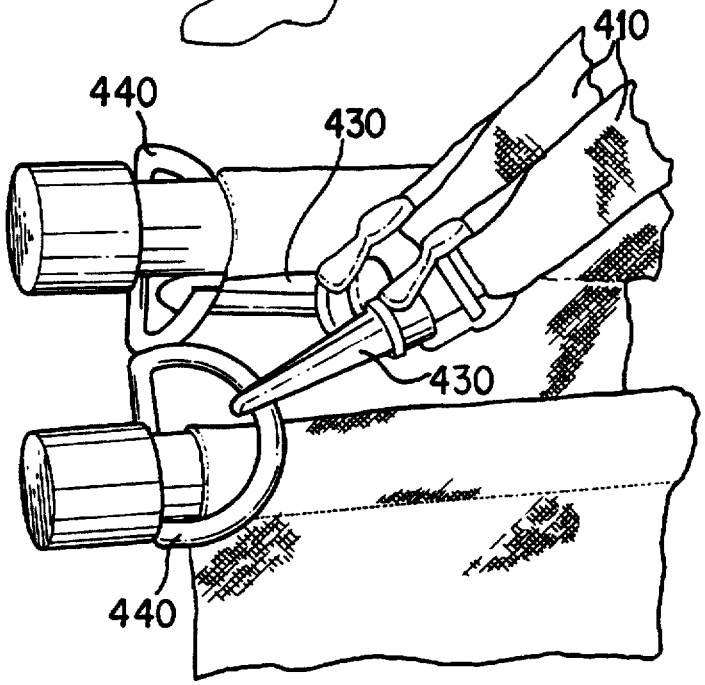
FIG. 2 is a detailed perspective view, partially cut-away, of a portion of the preferred embodiment of the subject versatile article carrier shown in FIG. 1.

Turning now to FIG. 2 there is shown a detailed view of the means by which each shoulder strap 410 is coupled to a frame member 100. A releasable hook mechanism 430 is suitably connected as shown at each end of shoulder strap 410. Each hook mechanism 430 releasably engages a coupling link 440 passing substantially diametrically through a given frame member 100. The hook mechanisms 430 and coupling links 440 are formed of a material having the strength and rigidity sufficient to withstand the maximum loads to be borne by article carrier 10. Similarly, shoulder straps 410 are formed of a high strength, though flexible, material capable of withstanding those maximum loads to which article carrier 10 may be subjected. Preferably, the hook mechanisms 430 and coupling links 440 are formed of a metallic composition, and shoulder straps 410 are formed of a woven nylon material.

Figure 3:
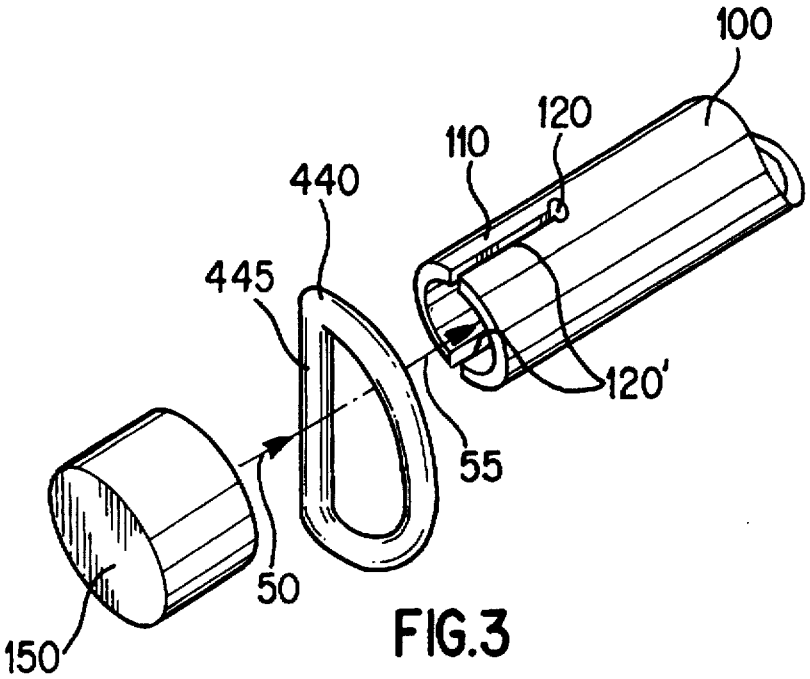
FIG. 3 is an exploded perspective view, partially cutaway, of a portion of the preferred embodiment of the subject versatile article carrier shown in FIG. 2.

Turning to FIG. 3, there is shown an exploded view of the means by which each coupling link 440 is connected to a frame member 100. At each end portion 110 of each tubular frame member 100 is formed a pair of diametrically opposed slots 120' which extend a predetermined distance longitudinally along the frame member 100. The slots 120' provide longitudinal access through the given frame member end portion 110 to a pair of diametrically opposed through openings 120.

As shown by the directional arrow 55, coupling link 440 is passed through these slots 120' to be engaged concurrently by the through openings 120. An end cap 150 is then coaxially fitted over the frame member end portion 110, as shown by the directional arrow 50, to trap coupling link 440 within through openings 120. Preferably, end cap 150 is adhesively coupled to the frame member end portion 110 to prevent its inadvertent decoupling therefrom.

Note that end cap 150 may alternatively be adapted for pressure fit over the frame member end portion 110 given that the slots 120' provide clearance for the flexure of frame member 100 radially inward at this end portion 110. Note also that each coupling link 440 is formed with a straight portion 445 to enable free translation of the coupling link 440 along the colinear axes of the diametrically opposed pair of through openings 120.

Figure 5:
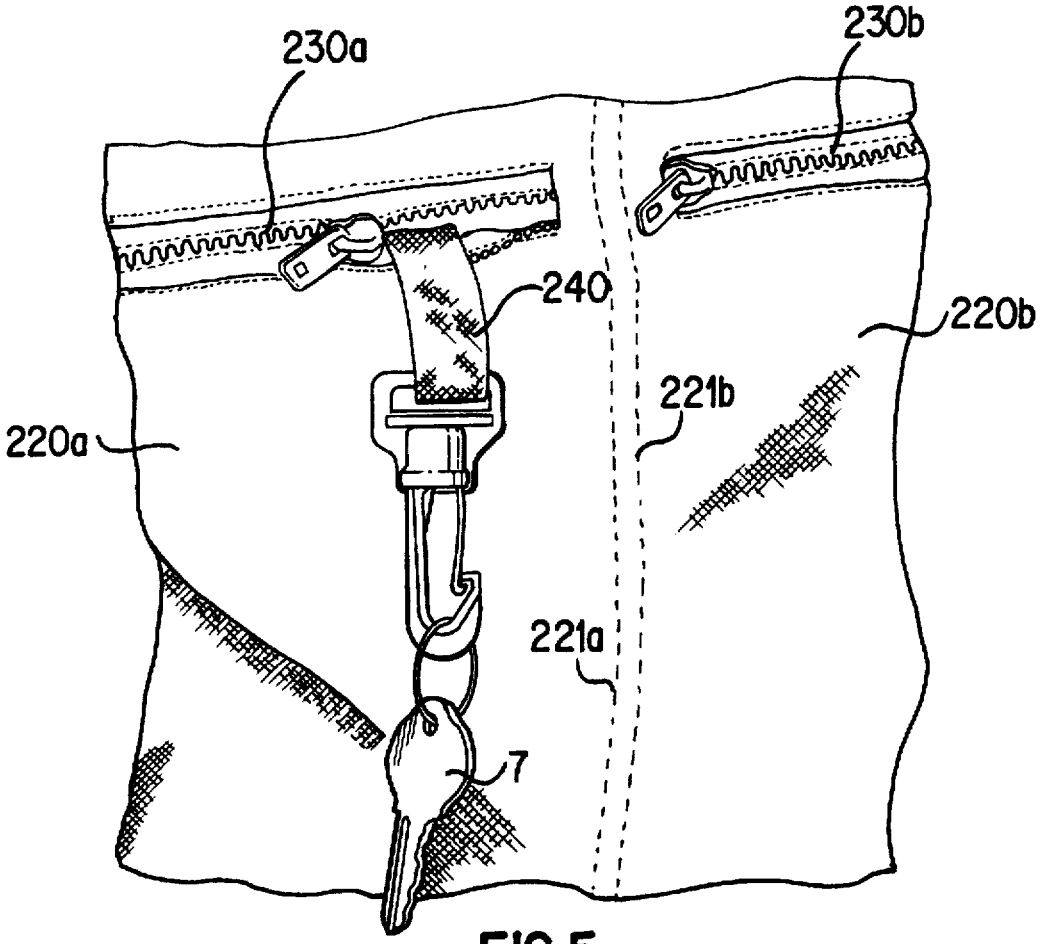
FIG. 5 is a perspective view, partially cut-away, of yet another portion of the preferred embodiment of the subject versatile article carrier shown in FIG. 1.

Referring to FIG. 5, within each compartment 220a, 220b, may be attached one or more attachment devices by which an item to be contained within a compartment 220a, 220b may be releasably attached to a portion of the carrier body 200 for enhanced security against its inadvertent escape from compartment 220a, 220b. One such attachment device is preferably a key strap assembly 240 of any suitable type commercially available to which a key 7 may be releasably coupled. As shown, the key strap assembly 240 is of sufficient length to allow the key 7 to be easily withdrawn from compartment 220a, 220b such that it may be freely manipulated and removed from/placed into engagement with the coupling mechanism of strap assembly 240.

Figure 6:
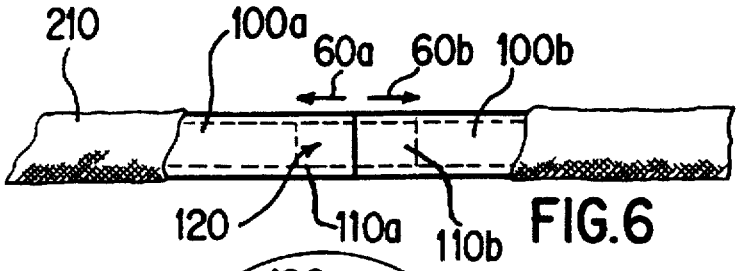
FIG. 6 is an elevational view, partially cut-away, of an alternate embodiment of a frame member in the subject versatile article carrier of the present invention.
Figure 7:
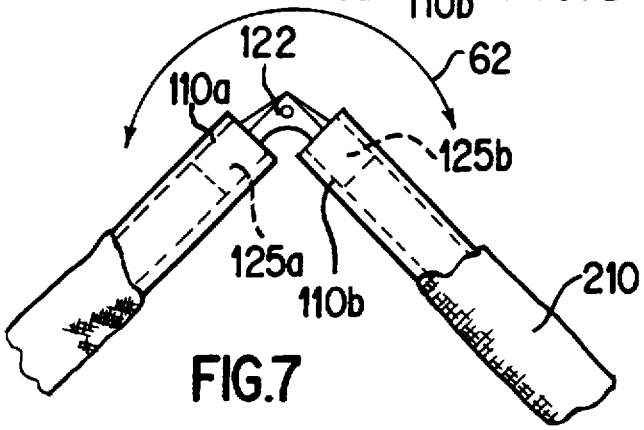
FIG. 7 is an elevational view, partially cut-away, illustrating the frame member of FIG. 6 in its partially collapsed configuration.
Figure 8:
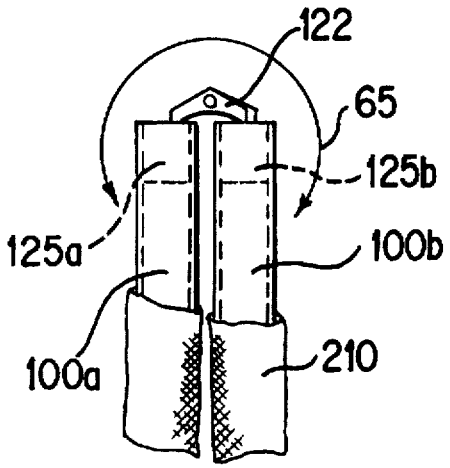
FIG. 8 is an elevational view, partially cut-away, of the frame member shown in FIG. 6 in its fully collapsed configuration; and, FIG. 9 is a perspective view, partially cut-away, of an alternate embodiment of the handling strap mechanism of the subject versatile article carrier.

Referring now to FIGS. 6–8, there is shown an alternate embodiment wherein each frame member 100 of versatile article carrier 10 is transversely collapsible. In that embodiment, each frame member 100 of versatile article carrier 10 is formed by a pair of frame member segments 100a, 100b longitudinally coupled together by a hinged coupler 120 which enables the frame member segments 100a, 100b to be pulled linearly apart, as shown by the directional arrows 60a, 60b, then angularly displaced, as shown by the directional arrows 62 and 65, to assume a folded, or collapsed, configuration. Hinged coupler 120 may be any one of several suitable types commercially available which includes a pair of bosses 125a, 125b retractably connected to a hinge assembly 122. Bosses 125a, 125b are pressure-fitted, respectively, within end portions 110a, 110b of frame member segments 100a, 100b. The sleeve 210 of the carrier body member 200 enveloping frame member segments 100a, 100b shown cut-away in FIGS. 6–8, may, if necessary, be formed with a cut-out to provide sufficient clearance for the occurrence of this collapsing action.

Figure 9:
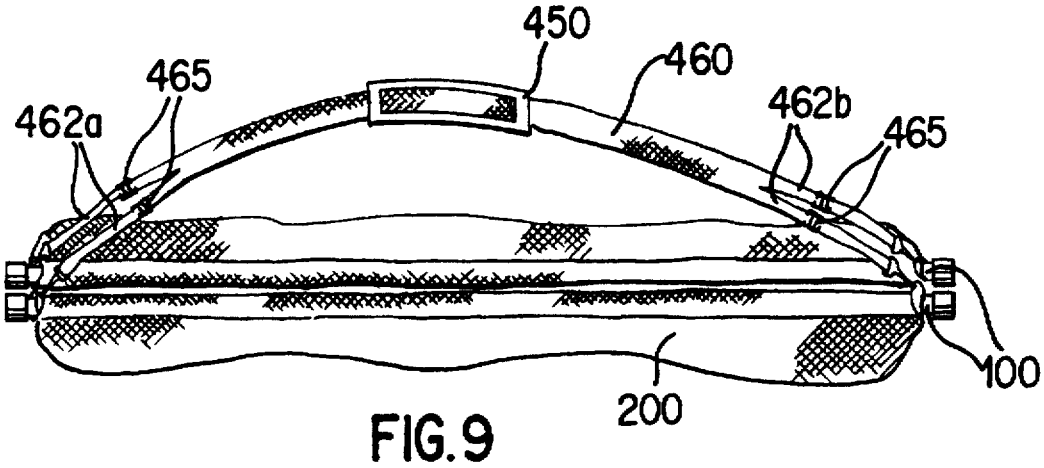

Referring now to FIG. 9, there is shown another alternate embodiment of the subject versatile article carrier 10. In that embodiment, the handling accessory 400 is embodied in the form of a single shoulder strap 460 having a pair of terminal portions from each of which a pair of strap segments 462a, 462b branch. Each branching strap segment 462a, 462b couples to a frame member 100 in the manner described above with reference to FIGS. 2–3 and is provided with a length adjustment buckle 465 for the length adjustment thereof in any suitable manner known in the prior art.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of material compositions may be employed, all without departing from the spirit or scope of the invention as defined in the appended Claims.

What is claimed is:

1. A versatile article carrier for carrying a plurality of discrete articles of various structural configuration comprising:

(a) at least a pair of longitudinally extended frame members;

(b) a carrier body member coupled to said frame members for supportingly capturing said articles, said carrier body member having opposing first and second end portions and a substantially flexible panel portion extending therebetween, said first and second end portions being coupled respectively to said pair of frame members, said panel portion having formed thereon at least one article receiving compartment;

(c) securing means coupled to at least one of said frame and carrier body members for adjustable securing at least one of said articles against one of said frame members, said securing means including at least a pair of looped strap members engaging one of said frame members for securing against said frame member a folded beach umbrella, said strap members being longitudinally displaced one from the other by a predetermined distance; and, (d) means for handling said carrier body releasably coupled to said frame members.

2. The versatile article carrier as recited in claim 1 wherein each of said frame members is transversely collapsible.

3. The versatile article carrier as recited in claim 2 wherein each of said frame members includes a hinged joint, said frame member being foldable thereabout.

4. The versatile article carrier as recited in claim 3 wherein each of said frame members includes elongate first and second segments detachably coupled one to the other by a hinged coupler.

5. The versatile article carrier as recited in claim 4 wherein said hinged coupler includes first and second hingedly connected bosses, said first boss matingly engaging said first segment of said frame member, said second boss matingly engaging said second segment of said frame member.

6. A versatile article carrier for carrying a plurality of discrete articles of various structural configuration comprising:

(a) at least a pair of longitudinally extended frame members;

(b) a carrier body member coupled to said frame members for supportingly capturing said articles, said carrier body member having opposing first and second end portions and a substantially flexible panel portion extending therebetween, said first and second end portions being coupled respectively to said pair of frame members, said panel portion having formed thereon at least one article receiving compartment;

(c) securing means coupled to at least one of said frame and carrier body members for adjustably securing at least one of said articles against one of said frame members; and, (d) means for handling said carrier body releasably coupled to said frame members, said handling means including a shoulder strap member, said shoulder strap member having a pair of distal terminal portions, each of said terminal portions terminating in a pair of strap segments branching therefrom, each said strap segment being releasably coupled to one of said frame members.

7. A versatile article carrier for carrying a plurality of discrete articles of various structural configuration comprising:

(a) at least a pair of longitudinally extended frame members;

(b) a carrier body member coupled to said frame members adapted to form between said frame members a sling structure for captively supporting said articles thereon, said carrier body member having opposing first and second end portions and a substantially flexible panel portion extending therebetween, said first and second end portions being coupled respectively to said pair of frame members, said panel portion having opposing inner and outer surfaces, said panel portion having formed on said outer surface thereof at least one article receiving compartment;

(c) securing means coupled to at least one of said frame members for releasably securing thereto at least one of said articles; and, (d) a pair of shoulder strap members releasably coupled, respectively, to said frame members.

8. The versatile article carrier as recited in claim 7 wherein said securing means includes at least a pair of looped strap members engaging one of said frame members for securing against said frame member a folded beach umbrella, said strap members being longitudinally displaced one from the other by a predetermined distance.

9. The versatile article carrier as recited in claim 7 wherein each of said frame members is transversely collapsible.

10. The versatile article carrier as recited in claim 9 wherein each of said frame members includes elongate first and second segments detachably coupled one to the other by a hinged coupler.

11. The versatile article carrier as recited in claim 7 wherein said article receiving compartment includes closure means for substantially enclosing therein the contents thereof.

12. A versatile article carrier for carrying a plurality of discrete articles of various structural configuration comprising:

(a) at least a pair of longitudinally extended and transversely collapsible frame members;

(b) a carrier body member coupled to said frame members for supportingly capturing said articles, said carrier body member having opposing first and second end portions and a substantially flexible panel portion extending therebetween, said first and second end portions being coupled respectively to said pair of frame members, said flexible panel portion having formed thereon a plurality of article receiving compartments, at least one of said compartments having closure means for substantially enclosing therein the contents thereof;

(c) securing means coupled to at least one of said frame and carrier body members for releasably securing thereto at least one of said articles, said securing means including at least a pair of looped strap members engaging one of said frame members for securing against said frame member a folded beach umbrella, said strap members being longitudinally displaced one from the other by a predetermined distance; and, (d) means for handling said carrier body releasably coupled to said frame members.

13. A versatile article carrier for carrying a plurality of discrete articles of various structural configuration comprising:

(a) at least a pair of longitudinally extended and transversely collapsible frame members, each of said frame members including a hinged joint, said frame member being foldable thereabout;

(b) a carrier body member coupled to said frame members for supportingly capturing said articles, said carrier body member having opposing first and second end portions and a substantially flexible panel portion extending therebetween, said first and second end portions being coupled respectively to said pair of frame members, said flexible panel portion having formed thereon a plurality of article receiving compartments, at least one of said compartments having closure means for substantially enclosing therein the contents thereof;

(c) securing means coupled to at least one of said frame and carrier body members for releasably securing thereto at least one of said articles; and, (d) means for handling said carrier body releasably coupled to said frame members.

* * * * *